US008360235B2

(12) United States Patent
Gibson

(10) Patent No.: US 8,360,235 B2
(45) Date of Patent: Jan. 29, 2013

(54) SMOKELESS TOBACCO CONTAINER

(75) Inventor: Paul Gibson, London (GB)

(73) Assignee: British American Tobacco (Investments) Limited, London (GB)

( * ) Notice: Subject to any disclaimer, the term of this patent is extended or adjusted under 35 U.S.C. 154(b) by 0 days.

(21) Appl. No.: 12/666,284

(22) PCT Filed: Jun. 24, 2008

(86) PCT No.: PCT/EP2008/058004
§ 371 (c)(1),
(2), (4) Date: Jun. 7, 2010

(87) PCT Pub. No.: WO2009/000829
PCT Pub. Date: Dec. 31, 2008

(65) Prior Publication Data

US 2010/0243488 A1 Sep. 30, 2010

(30) Foreign Application Priority Data

Jun. 27, 2007 (SE) ..... 0701570

(51) Int. Cl.
*B65D 85/10* (2006.01)

(52) U.S. Cl. ..... 206/261; 220/298; 220/288; 215/316; 215/329; 215/334; 206/265

(58) Field of Classification Search ..... 206/265, 206/242, 247, 251, 261, 274; 220/4.21
See application file for complete search history.

(56) References Cited

U.S. PATENT DOCUMENTS

| | | | | | |
|---|---|---|---|---|---|
| 2,481,095 | A | * | 9/1949 | Essman | 206/403 |
| 4,279,355 | A | | 7/1981 | Schwartz et al. | |
| 4,375,859 | A | | 3/1983 | Fillmore | |
| 4,915,255 | A | * | 4/1990 | Curtis | 220/23.89 |
| 5,012,947 | A | * | 5/1991 | Roland | 220/573.1 |
| 5,427,233 | A | * | 6/1995 | Zinck et al. | 206/69 |
| 5,839,368 | A | * | 11/1998 | Ohinata | 101/364 |
| 6,006,937 | A | * | 12/1999 | Baravaglio et al. | 220/62.18 |
| 6,161,711 | A | * | 12/2000 | Miceli et al. | 215/206 |

FOREIGN PATENT DOCUMENTS

| | | | |
|---|---|---|---|
| DE | 2513674 | A1 | 10/1976 |
| DE | 2603047 | A1 | 8/1977 |
| GB | 232090 | A | 4/1925 |
| GB | 463736 | A | 4/1937 |
| GB | 873273 | A | 7/1961 |
| GB | 2008550 | A | 6/1979 |

(Continued)

OTHER PUBLICATIONS

PCT International Search Report and Written Opinion mailed Nov. 25, 2008.

(Continued)

*Primary Examiner* — J. Gregory Pickett
*Assistant Examiner* — Raven Collins
(74) *Attorney, Agent, or Firm* — Cooley LLP

(57) ABSTRACT

A smokeless tobacco container (1) comprising in its closed state, a first and second portion, said portions being rotatably engageable with each other to define a space, said first portion (2) having release means, said second portion (3) having complementary engaging means such that only when in a selected position the release means can be aligned with the complementary engaging means thereby allowing separation of the two portions to open the container.

14 Claims, 8 Drawing Sheets

FOREIGN PATENT DOCUMENTS

| | | | |
|---|---|---|---|
| SE | 524025 | C2 | 6/2004 |
| SE | 527350 | C2 | 2/2006 |
| SE | 527361 | C2 | 2/2006 |
| WO | WO9925623 | A | 5/1999 |
| WO | 02/083516 | A1 | 10/2002 |
| WO | WO2006096117 | A1 | 9/2006 |

OTHER PUBLICATIONS

International Preliminary Report on Patentability mailed Aug. 12, 2009.

Search Report corresponding to Application No. SE0701570 mailed Dec. 7, 2007.

* cited by examiner

SMOKELESS TOBACCO CONTAINER

CLAIM FOR PRIORITY

This application is a National Stage Entry entitled to and hereby claims priority under 35 U.S.C. §§365 and 371 corresponding to PCT Application No. PCT/EP2008/058004, titled, "Smokeless Tobacco Container," filed Jun. 24, 2008, which in turn claims priority to Swedish Application Serial No. SE 0701570-4, filed Jun. 27, 2007, all of which are hereby incorporated by reference.

FIELD OF THE INVENTION

The present invention relates to a smokeless tobacco container and more particularly to a smokeless tobacco container having a tamper and/or child resistant closure.

BACKGROUND OF THE INVENTION

Most smokeless tobacco products are provided to the consumer in circular cardboard, metal or moulded plastic containers having a seal enclosing them prior to the first opening. When a consumer wishes to access the product, the seal is broken, the lid removed, and the desired amount of smokeless tobacco removed from the container. The lid is then replaced until further access to the product is required.

Such containers are normally discarded once the contents of the container have been consumed and thus there is a continued requirement that such articles can be manufactured in large quantities but at low cost. Known containers for smokeless tobacco products generally comprise a lower and upper section, the upper section of which may form a lid which allows the container to be opened and closed repeatedly to access the contents thereof until the container is empty.

Due to the inexpensive construction of conventional smokeless tobacco containers and the repeated opening and closing of the conventional lids, the lids tend to deform easily and become loose. Thus, once the seal is broken, the conventional containers and lids fail to provide the tight seal required to retain the flavour and freshness of the product and are known to cause unwanted spills.

A further significant disadvantage of the prior art containers is that as the containers themselves are manufactured to be easily accessed by the user, this in turn makes it easy for persons under the legal age requirement for consuming tobacco products and children in particular to access or indeed consume the contents thereof if the containers are left unattended.

SUMMARY OF THE INVENTION

An object of the present invention is to produce an improved smokeless tobacco container which obviates or mitigates some or all of the abovementioned problems of the prior art whilst also providing such a container with tamper and/or child resistant closure means.

According to the present invention there is provided a smokeless tobacco container comprising a first and second portion, said portions being rotatably engageable with each other to define a space, said first portion comprising an engaging means and a release means and said second portion having engaging means complementary to said release means such that only when in a selected position the release means are aligned with the complementary engaging means thereby permitting separation of the two portions of the container.

It is much by preference that the engaging means of the first and the second portions are interlockable in order to retain the portions of the container in engagement with one another unless and until the portions are rotated to the selected position.

Preferably the engaging means of the first portion is a rim and the release means comprises one or more interruptions therein.

Advantageously, the engaging means of the first portion and the engaging means of the second portion are elastically deformable such that when pressure is applied to the first and/or the second portion(s) of the container in the direction of the other portion they snap shut in any position without the need for alignment between the engaging means of the second portion and the release means of the first portion.

Advantageously the engaging means of the second portion comprises one or more projection(s) which are complementary to the release means of the first portion such that only when in a selected position will separation of the two portions of the container be possible.

In embodiments of the present invention comprising one or more projections as the engaging means of the second portion, the engaging means of the first portion is preferably a rim and the release means is or are one or more complementary interruptions in the rim such that only when the one or more projection is aligned with the complementary interruption(s) in the rim will separation of the two portions will possible.

Preferably the engaging means of the second portion and the engaging and release means of the first portion are located upon respective support members. Preferably each support member comprises an elongate or extension member which projects inwardly of the portion of the container upon which it is located. Even more preferably, each support member is provided by a flange extending inwardly of the portion of the container from which it depends.

Preferably the support means on respective portions of the container extend the engaging means of each portion such that they contact an internal surface of the other portion when the container is in the closed position. Advantageously each support means is formed integrally with the respective engaging means.

In preferred embodiments of the present invention the support means comprises a flat flange projecting inwardly from the interior surface of each portion of the container.

The first and second portions may each further comprise one or more indicator means located on an exterior surface thereof. More specifically, the position of the indicator means on each portion is preferably such that when one portion of the container is rotated relative to the other portion, the indicator means on the first portion is aligned with the indicator means of the second portion thereby confirming the corresponding alignment between the release means and the complementary engaging means of the second portion. In this way an indication is provided to the consumer that the selected position has been achieved and the container can be opened.

Advantageously the indicator means can be of any suitable shape or form such a purpose such as a triangular projection, a flange or a lug, for example.

In a preferred embodiment of the present invention the indicator means on each portion of the container is a triangular projection. When the triangular projections on each portion are aligned, a point of the triangular of each projection points to the corresponding point on the triangular of the other portion.

Alternatively, or in addition, the indicator means may be provided by a cut-out portion in an edge of the exterior surface of the first and second portions of the container. The cut-out portions on each portion of the container, when aligned in the selected position, may form a complete shape such as an ellipse for example.

In embodiments of the present invention comprising a cut-out portion in the exterior surface of each portion of the container, the first and/or the second portion preferably further comprises a closure member which covers the gap in the side wall of the container in the closed position thereof. Preferably the, or each, closure member is provided by the support member of the container.

It is much by preference that the engaging means of the second portion and the release means of the first portion are located on the closure member(s), if present.

Additionally the portions of the container may comprise external leverage means which may serve to assist in alignment of the portions as well as for opening the container. Such leverage means may be in the form of flanges, lugs or tabs, for example.

Suitably, limiting means may be provided to reduce or prevent over deformation of the container when pressure is applied to both portions as the portions are closed or, indeed, when the container is in the closed position. Preferably the limiting means is provided by one of more of the support members of the container.

Additionally or in the alternative a limiting member may be integrally formed on the interior surface of the portion comprising the release means such that when the container is in its closed position the support member(s) contact said limiting member to prevent over deformation of the portions.

Sealing means may also be provided around the circumferential meeting point of the two portions when in the closed position to be removed and discarded upon first use of the container by the consumer. It is much by preference that the sealing means is provided by a plastic label which is at least partially removable from the container. More preferably the sealing means is an adhesive tape covering the circumferential meeting point of the portions of the container.

When referred to herein, the term smokeless tobacco shall include oral tobacco such as chewing tobacco, lozenges and loose tobacco, for example, and snus tobacco products. It will readily be understood from the present disclosure that the container described herein may also contain tobacco products intended to be smoked such as loose tobacco for use in pipes and roll-your-own products, for example.

BRIEF DESCRIPTION OF THE DRAWING FIGURES

In order that the invention by easily understood and readily carried into effect, reference will now be made, by way of example, to the accompanying drawings in which.

DETAILED DESCRIPTION

Figure 1:
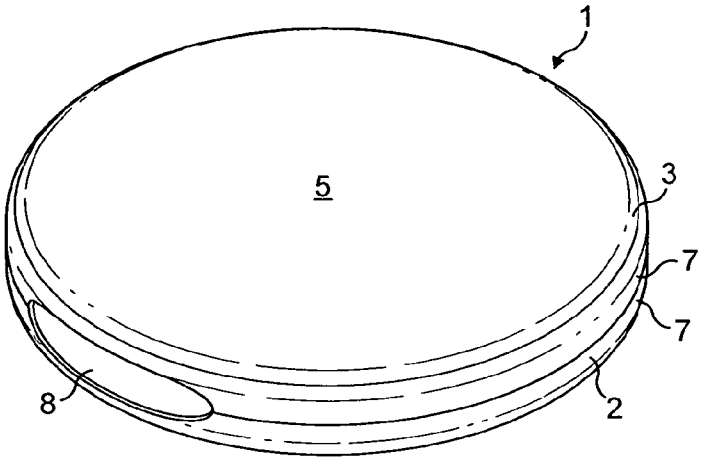
FIG. 1 is a perspective view of one embodiment of a container according to the present invention.
Figure 2:
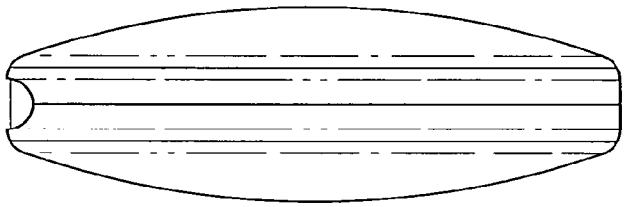
FIG. 2 is a side elevation of the container of FIG. 1.
Figure 3:
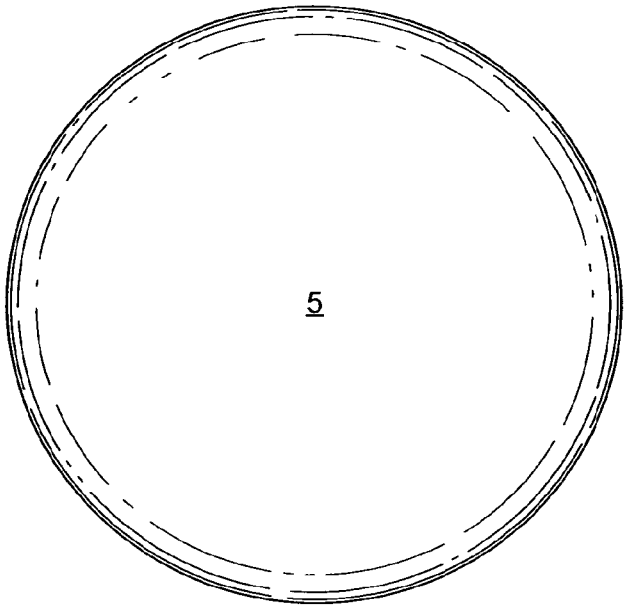
FIG. 3 is a plan view from above of the container of FIG. 1.

In the accompanying drawings like features are depicted by the same reference numeral throughout.

FIGS. 1-6 depict a smokeless tobacco container 1 according to a first embodiment of the present invention.

The container 1 has a first portion 2 and a second portion 3 which together define an interior space 4 when the container 1 is in its closed state. In the depicted embodiment the container 1 is cylindrical, having a circular cross-section with a diameter greater than the height dimension of the cylinder.

The second portion 3 of the container 1 has a base wall 5 with a side wall 6 upstanding from the edge of the base wall 5. The base wall 5 of the second portion 3 is circular with the side wall 6 upstanding from the edge of the circular base. It will be readily understood that the first portion 2 also has a base wall (not shown in FIG. 1) and a side wall 7 as described in relation to the second portion 3.

In the embodiment depicted in FIGS. 1-6, the edges of the container 1 between the base and the side walls of the first and second portions are rounded. The edges may alternatively be beveled, square, in indeed any other suitable shape.

Depending on the orientation of container 1, the base walls of the first and second portions will form either the base or lid of the container 1. A side wall of container 1 is formed when the side walls (7, 6) of the first and second portions (2, 3) abut when the container 1 is in the closed position.

Container 1 of FIGS. 1-6 also has a cut-out portion 8 in the side wall. The cut-out portion 8 is formed in two parts by cut-out portions in the side walls (6, 7) of the first and second portions (2, 3) of the container 1. Alignment of the two parts of the cut-out portion 8 is achieved by rotation of the first and the second portions (2, 3) relative to one another. In the depicted embodiment the cut-out portion is an indicator means which provides an indication to the consumer that the portions of the container 1 are in the selected position and can be separated thereby providing access to the contents in the interior space 4.

Figure 4:
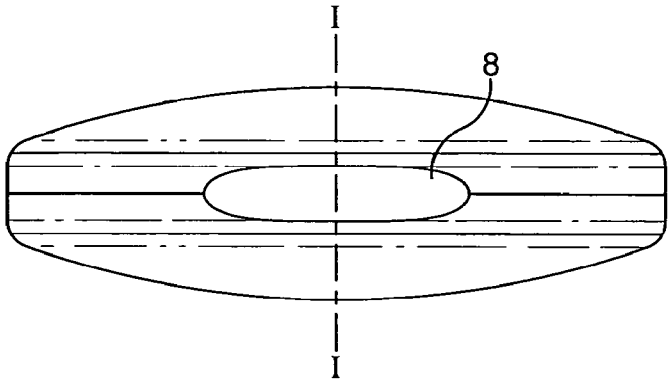
FIG. 4 is a front elevation of the container of FIG. 1.
Figure 5:
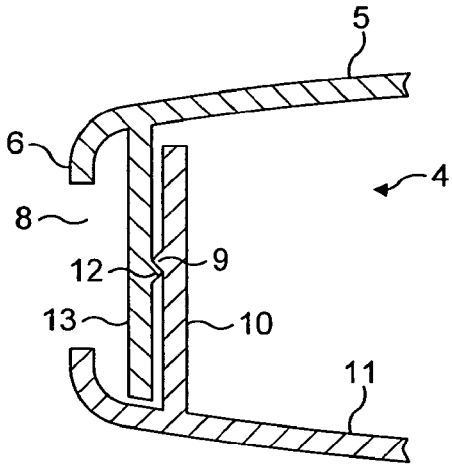
FIG. 5 is a vertical cross-section of a portion of the container of FIG. 4 along line I-I.

FIG. 5 shows the container 1 of FIG. 1 in partial vertical cross-section. The engaging means of the first portion 2 is provided by a rim 9 and the release means of the first portion by a gap (not shown) in the rim 9. The rim 9 is located on a supporting flange 10 which is formed integrally with and extends inwardly from the base wall 11 of the first portion 2. The engaging means of the second portion is a triangular projection 12 which is complementary to and dimensioned so as to be moveable through the gap in the rim 9 when the projection 12 and the gap in rim 9 are in alignment with one another. Alignment of the projection 12 and the gap in rim 9 is achieved by rotation of the first portion 2 relative to the second portion 3. Although it is noted that FIG. 4 shows the first and second portions in alignment, the cross-sectional view shows the rim and projection for purposes of completeness.

Projection 12 is located on a supporting flange 13 which is formed integrally with and extends inwardly from the base wall 5 of the second portion 3. When container 1 is in the closed position, supporting flange 13 is in contact with the base wall 11 of the first portion 2 and thereby prevents excessive distortion of the lid portion of the container 1 which lid portion (in the depicted embodiment) is provided by the second portion 3.

The supporting flanges 10 and 12 also act as closure members for the cut-out portion 8, such that the product is not visible when the two parts of the cut-out portion 8 are in alignment with one another.

The supporting flanges 10 and 12 are elastically deformable such that the container 1 may be closed by snap-fit as rim 9 and projection 12 move past each other during the closure of the container 1. Thus, container 1 can be closed even when the projection 12 is not in alignment with the gap in rim 9.

Figure 6:
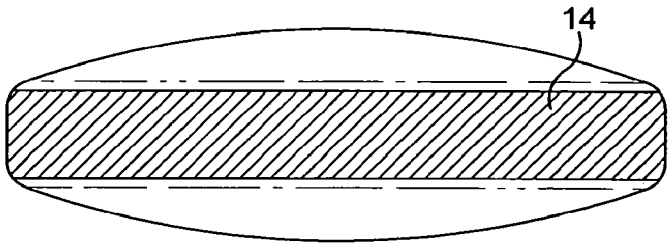
FIG. 6 shows the container of FIG. 1 with the sealing means in place prior to first opening of the container.
Figure 7:
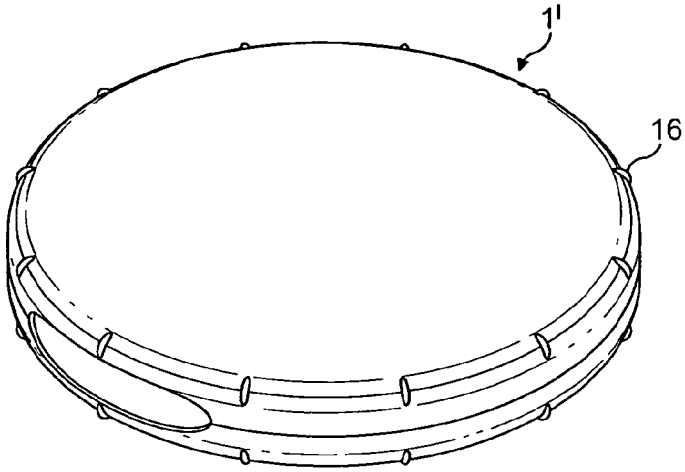
FIG. 7 is a perspective view of a second embodiment of a container according to the present invention.
Figure 8:
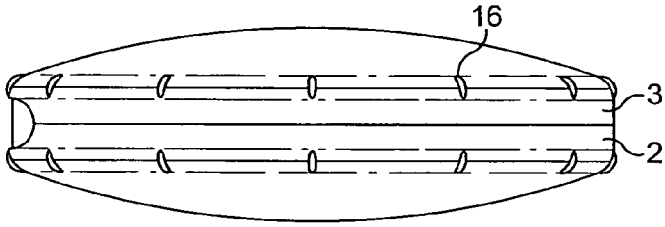
FIG. 8 is a side elevation of the container of FIG. 7.
Figure 9:
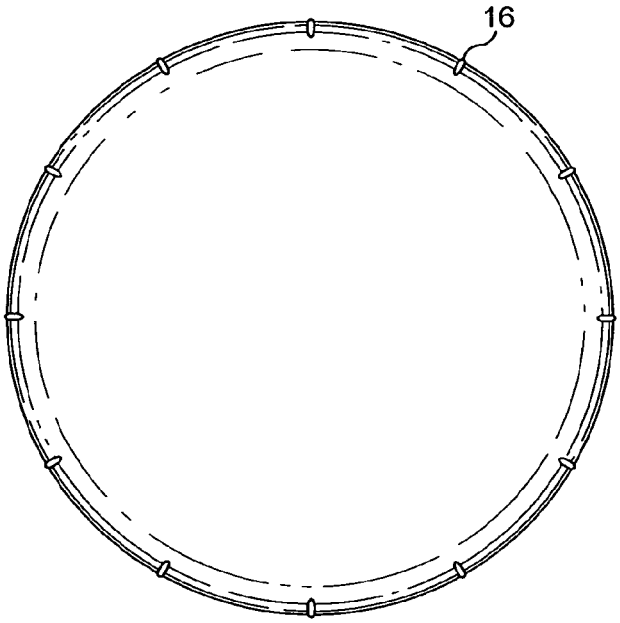
FIG. 9 is a plan view from above of the container of FIG. 7.
Figure 10:
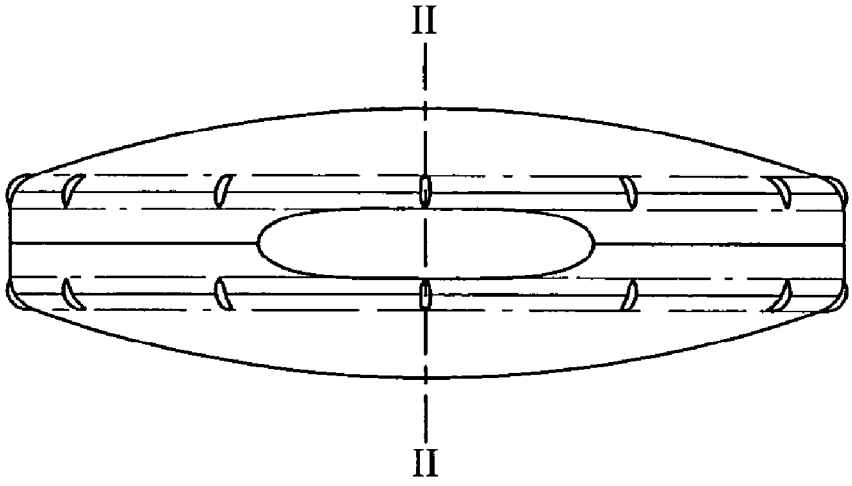
FIG. 10 is a front elevation of the container of FIG. 7.

FIG. 6 shows the container 1 prior to first opening by a consumer. The sealing tape 14 is attached to the side wall of the container 1 over the line of abutment between the first and the second portions 2, 3. The sealing tape 14 also covers cut-out portion 8. The sealing tape 14 is attached to the container 1 by adhesive which is strong enough to retain the tape 14 in position until the consumer grasps on a pull tab (not shown) and removes the tape 14 from the container 1. The tape 14 and/or the container 1 may be printed with indicia and/or graphics.

As will be readily understood, the container 1 can generally be of any suitable shape such as a straight walled cylinder (or variations thereof). Depending on the required shape of the container the base walls of the first and/or second portions may be flat, arched, convex or concave. Further the size and shape of the space defined by the container is a matter of design choice for the skilled artisan.

In the embodiment shown the first and second portions 2, 3 have the same circumferential dimensions and are of equal depth. It will be understood that the depth dimensions of the first and second portions may vary and may be such that one of the portions has equal, greater or less depth than the other.

Figure 11:
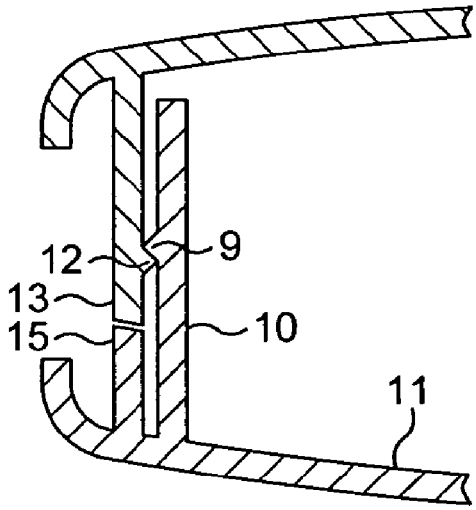
FIG. 11 is a vertical cross-section of a portion of the container of FIG. 10 along line II-II.
Figure 12:
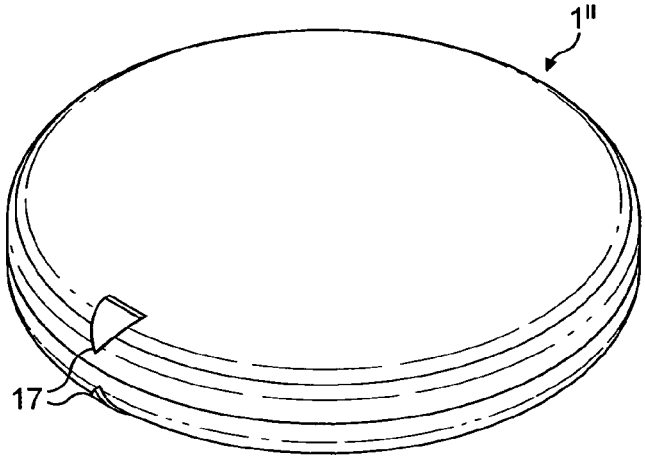
FIG. 12 is a perspective view of a third embodiment of a container according to the present invention.
Figure 13:
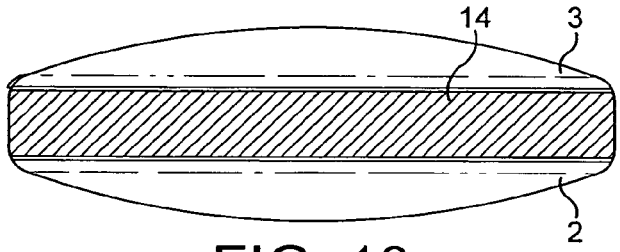
FIG. 13 is a side elevation of the container of FIG. 12.
Figure 14:
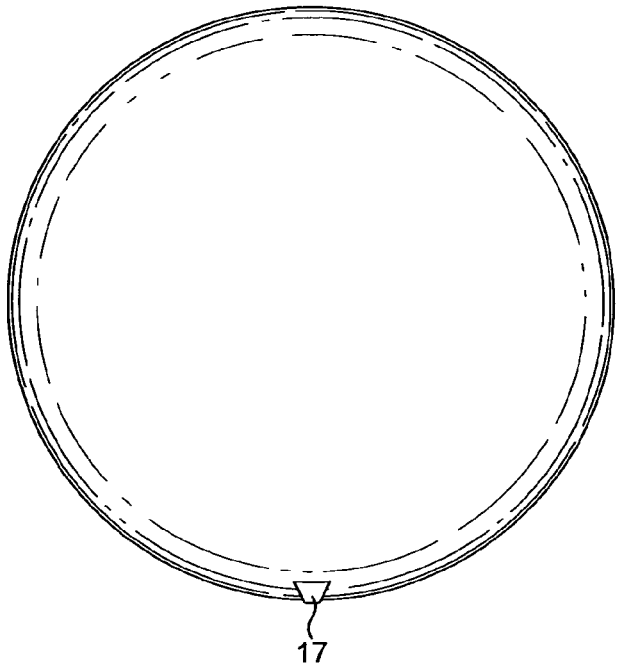
FIG. 14 is a plan view from above of the container of FIG. 12.
Figure 15:
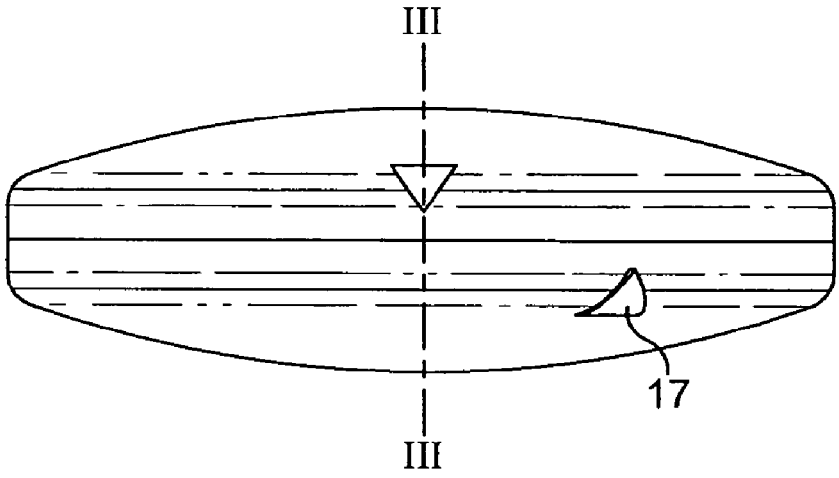
FIG. 15 is a front elevation of the container of FIG. 12.
Figure 16:
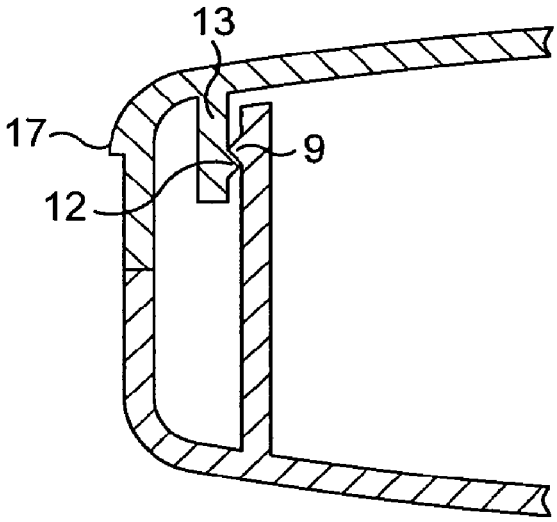
FIG. 16 is a vertical cross-section of a portion of the container of FIG. 15 along line III-III.
Figure 17:
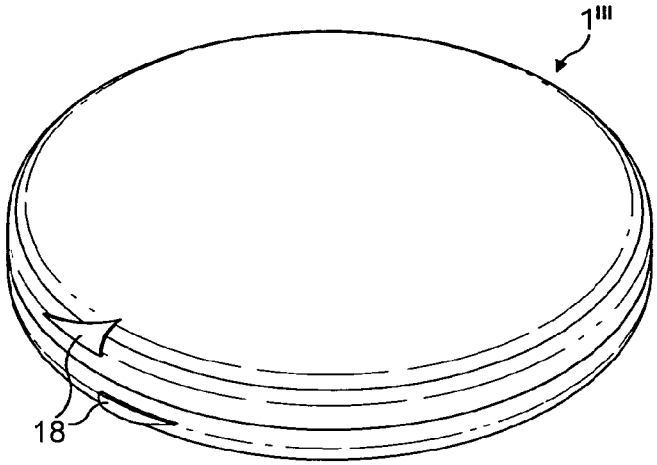
FIG. 17 is a perspective view of a fourth embodiment of a container according to the present invention.
Figure 18:
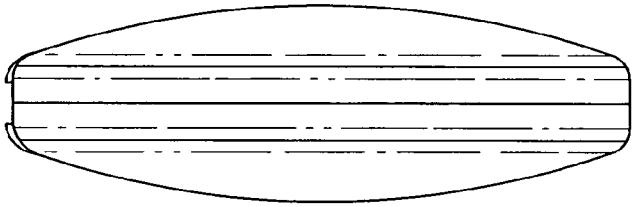
FIG. 18 is a side elevation of the container of FIG. 17 in the openable position.
Figure 19:
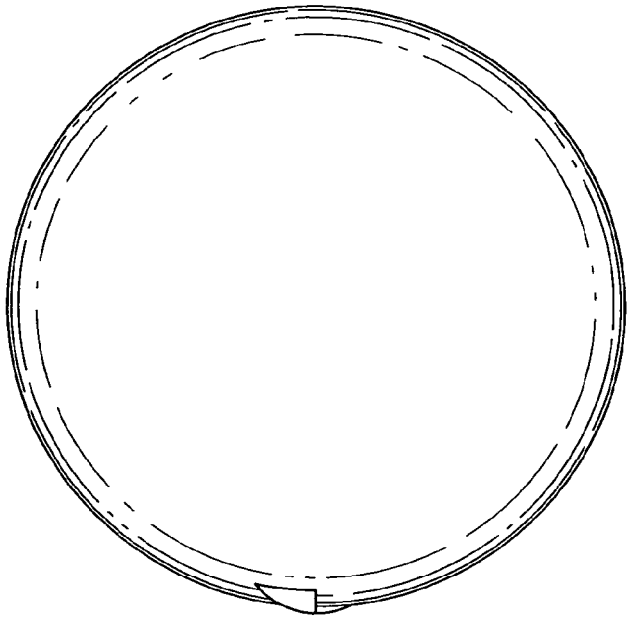
FIG. 19 is a plan view from above of the container of FIG. 17.
Figure 20:
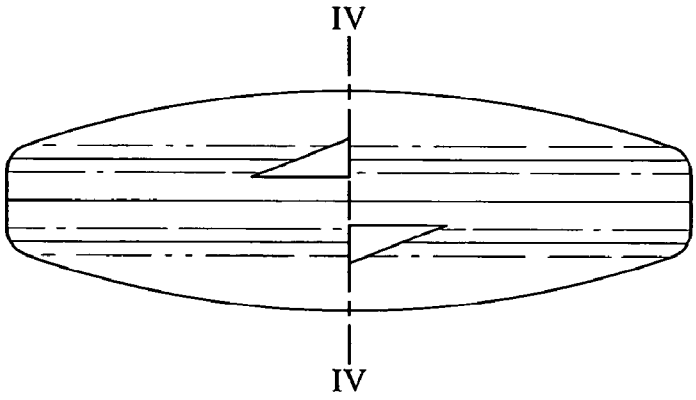
FIG. 20 is a front elevation of the container of FIG. 17.
Figure 21:
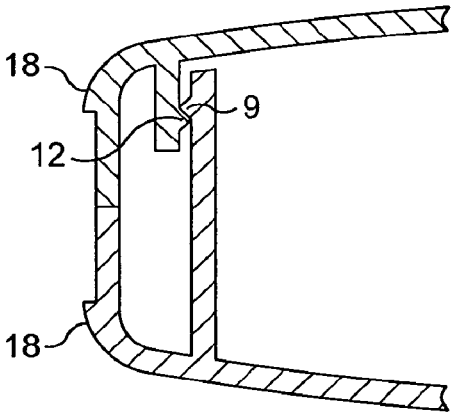
FIG. 21 is a vertical cross-section of a portion of the container of FIG. 20 along line IV-IV.

The container 1' depicted in FIGS. 7-11 differs from that of FIGS. 1-6 in that the first portion 2 has a limiting means 15 in the form of an detent integrally formed with the base wall 11 as is clearly shown in FIG. 11. As the first and second portions 2, 3 of the container 1' are pushed together into the closed position, the limiting means 15 prevents the supporting flange 13 of the second portion 3 from being pushed past the point where the flange 13 abuts the limiting means 15, thus preventing excessive deformation of the supporting flanges 10 and 13 and of the container 1'.

The first portion 2 of container 1' of FIGS. 7-11 has a curved base wall 11. It will be readily understood that alternative shapes so as a flat base wall, for example, are well within the scope of the present invention. The container 1' also has detents 16 in the exterior surface thereof. The detents 16 provide a better grip for the consumer in use of the container 1'.

FIGS. 12-16 depict a further alternative embodiment of the present invention. Container 1" differs from the previously depicted containers (1, 1') in that instead of a cut-out portion, indication means are provided to show when the engaging means 12 are in alignment with the gap in rim 9 and, therefore, that the first and second portions 2,3 can be separated. Indication means comprise corresponding triangular lugs 17 on the first and second portions 2, 3. Further, in this embodiment, there is no cut-out in the side walls of the two portions, therefore, the supporting flange 13 of the second portion 3 does not extend into the interior space delimited by the first portion 2.

FIGS. 17-22 depict a fourth alternative embodiment of a container 1'" according to the present invention. The container 1'" differs from that shown in FIGS. 12-16 in that in addition to triangular lugs 17 are provided flanges 18. Flanges 18 provide indication when the gap in rim 9 and projection 12 are aligned for separation of the first and second portions of the container 1'". Flanges 18 also provide external leverage means by which the consumer may easily separate the two portions when same are in the selected position in which projection 12 is moveable through the gap in rim 9.

Figure 22:
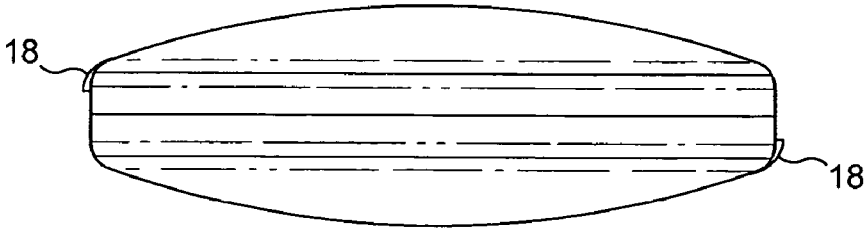
FIG. 22 is a side elevation of the container of FIG. 17 in the transit position.

FIGS. 17-21 show the container 1'" in a position in which separation of the two portions and, therefore, opening of the container will readily occur. FIG. 22, on the other hand, shows the container 1'" in a transit position in which the flanges 18 on the respective portions are rotated so as to be 180° apart from one another making the possibility of accidental opening remote.

In use of any of the depicted containers, the first and second portions are configured such that they are rotatably engageable with each other. The first portion is provided with an engaging means in the form of an internal rim and a release means which can be, but are not limited to, one or more breaks, grooves or cuts are made in the internal rim. The second portion is provided with engaging means, preferably in the form of projections or protrusions, which are configured so as to be complementary in shape and dimension to the release means of the first portion.

The first and second portions are correspondingly configured in such a way that only at selected positions can the release means i.e breaks, cuts or grooves, be aligned with the complementary engaging means i.e. projections thereby allowing separation of the two portions to open the container. In operation, alignment of the release means and the complementary engaging means is achieved by rotation of the first and second portions relative to one another. Unless and until the projections and breaks are aligned with one another, the container is considered to be in its closed state and cannot be prised open; the container is effectively locked or tamper proof. When the container is in a closed state the rim and projections maintain an interference fit. In other words, the two portions although rotatably engageable are formed in such a way as to form a snug fit between the rim and the projection to ensure that until they are aligned to be opened they cannot be prised apart.

In order to assist with the alignment of the release and engaging means external surfaces of the first and second portions are provided with external indicators which are positioned so as to indicate the alignment between the projections and breaks in the internal rim. The indicators may simply perform the function of indicating suitable alignment or in addition may project from the lateral walls of the portions to provide leverage means by which to apply pressure to push apart the first and second portions in order to open the container or alternatively to assist in rotation of the portions to the selected position of alignment. The indicators can be in many shapes or forms suitable for such a purpose such as triangular projections, flanges, lugs or tabs, for example.

In the closed state the projections and breaks are deliberately misaligned to effectively "lock" the container by rotating the portions relative to one another such that the exterior indicators are misaligned. When the consumer wants to open the container, the indicator markings are aligned whereby the projections and corresponding breaks of the portions align with each other allowing the user to open the container.

The container, the release means and the engaging means are generally made of a moulded plastics material. The plastics material should be sufficiently deformable such that when pressure is applied to the two portions of the container they snap shut in any position without the need for alignment between the projections and breaks in the rim.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

The invention claimed is:

1. A generally cylindrical smokeless tobacco container having a circular cross-section and a diameter greater than its height dimension, comprising:

a first and second portions, each of said portions comprising a base wall and an upstanding side wall with a generally circular outermost edge around the periphery of the base wall and being rotatably engageable with each other to define a space with said circular outermost edges of each of the upstanding side wall in abutment with one another, said first portion comprising an engaging element and a release element and said second portion having an engaging element complementary to said release element such that only when in a selected rotary position relative to the first portion the release element can be aligned with the complementary engaging element thereby allowing separation of the two portions to open the container, said engaging element of the second portion being engageable with the engaging element of the first portion to close the container in any rotary position of the first portion relative to the second portion except for said selected rotary position, wherein said engaging and release elements of the first portion and said engaging element of the second portion are located upon respective support members located inwardly of the side walls of the first and second portions so to be screened from the outside of the container by the side walls, the respective support members projecting towards one another from the portion of the container upon which they are located.

2. The smokeless tobacco container according to claim 1, wherein the engaging element of the first portion is a rim and the release element comprises one or more interruptions in said rim.

3. The smokeless tobacco container according to claim 1, wherein the engaging element of the first portion and the engaging element of the second portion are elastically deformable.

4. The smokeless tobacco container according to claim 1, wherein the engaging element of the second portion comprises one or more projections.

5. The smokeless tobacco container according to claim 1, wherein each support member comprises an elongate member.

6. The smokeless tobacco container according to claim 1, wherein each support member is a flange.

7. The smokeless tobacco container according to claim 1 further comprising one or more indicator element located on an exterior surface thereof.

8. The smokeless tobacco container according to claim 7, wherein each of said first and said second portions comprises one or more indicator element located on an exterior surface thereof.

9. The smokeless tobacco container according to claim 7, wherein the indicator element is a triangular projection.

10. The smokeless tobacco container according to claim 7, wherein the indicator element comprises a cut-out portion in an edge of the exterior surface of said first and said second portions of said container.

11. The smokeless tobacco container according to claim 10, wherein at least one of said first and second portions further comprise a closure member which covers the cut-out portion.

12. The smokeless tobacco container according to claim 1, further comprising an external leverage element.

13. The smokeless tobacco container according to claim 1, wherein the engaging elements of the first and second portions are engageable with a snap-fit in any rotary position of the portion relative to the second portion except for said selected rotary position.

14. The smokeless tobacco container according to claim 1, wherein a first of the support members on one of said first and second portions is configured to abut the other of said first and second portions such that deformation on the first portion is reduced when the container is closed.

* * * * *